US006764337B2

(12) United States Patent
Nishio et al.

(10) Patent No.: US 6,764,337 B2
(45) Date of Patent: Jul. 20, 2004

(54) CONNECTOR WITH IMPROVED RELIABILITY

(75) Inventors: Atsushi Nishio, Mito (JP); Katsuhiro Hori, Mito (JP); Fumihiro Hosoya, Mito (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 11 days.

(21) Appl. No.: 10/106,342

(22) Filed: Mar. 26, 2002

(65) Prior Publication Data

US 2002/0142657 A1 Oct. 3, 2002

(30) Foreign Application Priority Data

Mar. 29, 2001 (JP) ..... 2001-097101

(51) Int. Cl.[7] ..... H01R 13/648
(52) U.S. Cl. ..... 439/607; 439/609

(58) Field of Search ..... 439/607, 609, 439/939, 573, 564, 610, 660, 79, 83

(56) References Cited

U.S. PATENT DOCUMENTS 5,266,038 A * 11/1993 Nakamura ..... 439/79

* cited by examiner

*Primary Examiner*—P. Austin Bradley
*Assistant Examiner*—Phuongchi Nguyen
(74) *Attorney, Agent, or Firm*—Ladas & Parry

(57) ABSTRACT

A connector includes a housing formed of resin and having contacts provided therein, a shield case formed of metal, engaging grooves formed in the housing, and engaging convex parts formed on the shield case. The housing is inserted into the shield case so as to be attached thereto. The engaging convex parts engage the engaging grooves when the housing is inserted into the shield case.

19 Claims, 8 Drawing Sheets

23
30
32
Y1
Y2
Z1
Z2

23
35
30
34
31
X1
X2

23
35
31
32
30

23
35a
35b
35
30
31

CONNECTOR WITH IMPROVED RELIABILITY

BACKGROUND OF THE INVENTION

1. Field of the Invention

The present invention generally relates to connectors, and more particularly to a connector formed by attaching a housing in which contacts are provided to a shield case.

2. Description of the Related Art

FIGS. 1A through 3 are diagrams showing a conventional connector 1. FIGS. 1A through 1C are a plan view, a front view, and a side view of the connector 1, respectively. FIG. 2 is a sectional view of the connector 1. FIG. 3 is an exploded view of the connector 1.

The connector 1 is composed mainly of a shield case 2, a housing 3, and contacts 4. The contacts 4 are attached to the housing 3, which is attached inside the shield case 2.

The shield case 2 has a substantially cylindrical shape and is formed of conductive metal such as a copper alloy. As shown enlarged in FIGS. 4A through 4C, a side fixed strip 6 is formed on each of the longitudinal opposing sides of a cylindrical case main body 5 of the shield case 2. Further, an upper fixed strip 7 is formed on each side of the upper surface of the case main body 5. Each of the fixed strips 6 and 7 is formed so as to extend inward at an angle. The side fixed strips 6 have the function of holding a plug attached to the connector 1 in the attached state. Further, the upper fixed strips 7 engage the housing 3 so that the housing 3 is fixed inside the shield case 2.

Flange parts 8 are formed on a bottom part of the main body 5 so as to extend outward therefrom. The flange parts 8 are connected to ground terminals formed on the circuit board of an electronic apparatus when the connector 1 is mounted on the circuit board. Thereby, the shield case 2 performs a shield function.

Further, an engaging groove 9 is formed on an $X_2$ end part of each of the longitudinal sides of the case main body 5 of the shield case 2 so as to extend substantially parallel to the $X_1$–$X_2$ axis as shown in FIGS. 1C, 3, and 4C. The $X_2$ end part refers to an end part of each of the longitudinal sides of the case main body 5 on the $X_2$ side, from which the housing 3 is inserted into the case main body 5 as indicated by the arrow in FIG. 3.

On the other hand, the housing 3 is formed of resin. As shown enlarged in FIGS. 5A through 5D, the housing 3 includes a housing main body 10 and an extension part 11 that are formed integrally with each other. The contacts 4 are provided inside the housing 3 as shown in FIG. 2. Contact insertion holes 12 are formed in the housing main body 10 for the purpose of attaching the contacts 4 to the housing 3.

The extension part 11 is formed to extend from the housing main body 10 in the $X_1$ direction as shown in FIGS. 5A and 5B. Contact attachment grooves 14 are formed in the extension part 11 for the purpose of positioning the contacts 4 in given positions.

Further, an engaging convex part 15 is formed on each of the side parts of the housing main body 10 which side parts extend along the $X_1$–$X_2$ axis. The engaging convex parts 15 protrude outward from the sides of the housing main body 10 and extend along the $X_1$–$X_2$ axis for a given length.

Next, a description will be given, with reference to FIG. 3, of a conventional method of assembling the connector 1. As shown in FIG. 3, in order to assemble the connector 1, the housing 3 in which the contacts 4 are provided beforehand is inserted into the cylindrical shield case 2.

At this point, positions in which the engaging grooves 9 are formed in the shield case 2 correspond to positions in which the engaging convex parts 15 are formed on the housing 3. Therefore, insertion of the housing 3 is performed by positioning the housing 3 with respect to the shield case 2 so that the engaging convex parts 15 are inserted into the engaging grooves 9. Thereby, the housing 3, which has a relatively elongated shape along the $X_1$–$X_2$ axis of FIG. 3, is attached to the shield case 2 with reliability and ease.

However, in the conventional connector 1, the engaging grooves 9 are formed in the metal shield case 2 and the engaging convex parts 15 are formed on the resin housing 3. That is, according to the conventional configuration, the engaging convex parts 15 are formed on the resin housing 3, which is weaker in strength than the metal shield case 2.

As previously described, the engaging grooves 9 and the engaging convex parts 15 are provided for positioning of the shield case 2 and the housing 3 at the time of assembly of the connector 1. Therefore, if the housing 3 is deformed in a direction indicated by arrow B in FIG. 3 at the time of positioning in the case of inserting the housing 3 into the shield case 2, a great external force is applied to the engaging convex parts 15.

Further, the engaging convex parts 15, which are formed of resin to protrude outward, have a low mechanical strength. Therefore, when the external force is applied to the engaging convex parts 15 as described above, the engaging convex parts 15 may be chipped so that the reliability of the connector 1 is reduced.

SUMMARY OF THE INVENTION

Accordingly, it is a general object of the present invention to provide a connector in which the above-described disadvantage is eliminated.

A more specific object of the present invention is to provide a connector whose reliability is improved.

The above objects of the present invention are achieved by a connector including a housing formed of resin and having contacts provided therein, a shield case formed of metal, engaging grooves formed in the housing, and engaging convex parts formed on the shield case, wherein the housing is inserted into the shield case so as to be attached thereto, and the engaging convex parts engage the engaging grooves when the housing is inserted into the shield case.

According to the above-described connector, the engaging grooves are formed in the resin housing and the engaging convex parts are formed on the shield case of metal, which provides a higher mechanical strength than resin. Therefore, the engaging convex parts having such high mechanical strength are prevented from being damaged by insertion or extraction of the housing into or from the shield case. Further, a higher mechanical strength is provided by forming the engaging grooves in the resin housing than forming engaging convex parts on the resin housing as in the configuration of the conventional connector.

Therefore, according to the configuration of the above-described connector, the engaging grooves and the engaging convex parts are prevented from being damaged so that the reliability of the connector is improved.

The above objects of the present invention are also achieved by a connector including a first member having contacts provided therein, a second member shielding the first member, engaging grooves formed in the first member, and engaging convex parts formed on the second member, wherein the first member is inserted into the second member so as to be attached thereto, and positions in which the engaging grooves are formed in the first member correspond to positions in which the engaging convex parts are formed on the second member when the first member is inserted into the second member.

Additionally, in the above-described connector, the second member may be formed of a conductive material that provides a higher mechanical strength than a material of the first member.

The above-described connector can produce the same effects as described above.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description will now be given, with reference to the accompanying drawings, of an embodiment of the present invention.

Figure 1A:
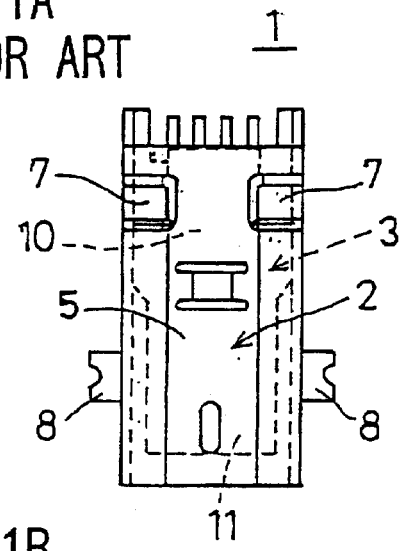
FIG. 1A PRIOR ART
FIG. 1A through 1C are a plan view, a front view and a side view of a conventional connector, respectively.
Figure 1B:
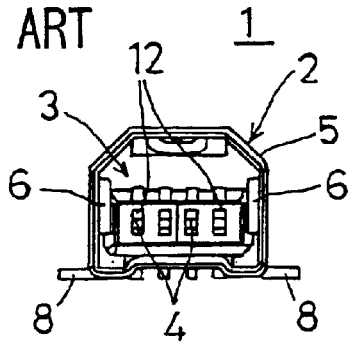
FIG. 1B PRIOR ART
Figure 1C:
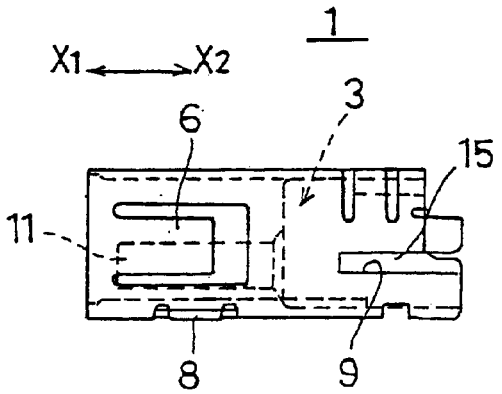
FIG. 1C PRIOR ART
Figure 2:
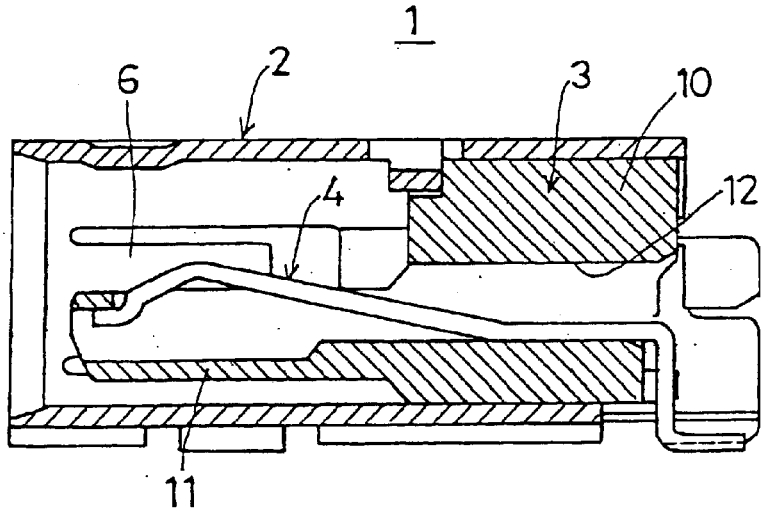
FIG. 2 PRIOR ART
FIG. 2 is a sectional view of the conventional connector.
Figure 3:
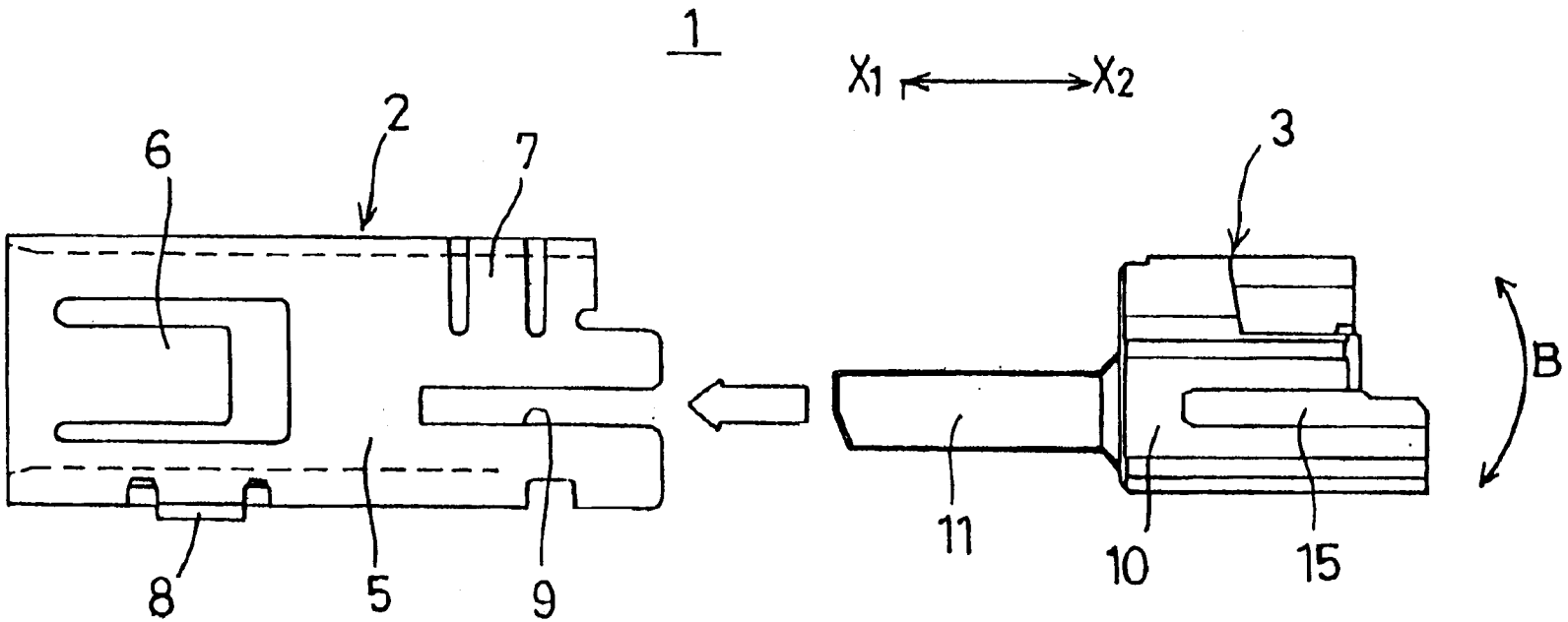
FIG. 3 PRIOR ART
FIG. 3 is an exploded view of the conventional connector.
Figure 4A:
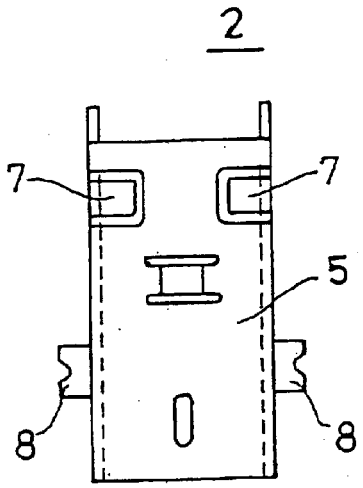
FIG. 4A PRIOR ART
FIGS. 4A through 4C are a plan view, a front view, and a side view, respectively, of a shield case of the conventional connector.
Figure 4B:
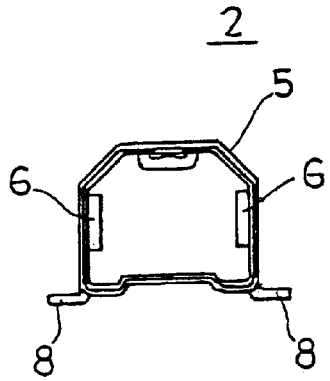
FIG. 4B PRIOR ART
Figure 4C:
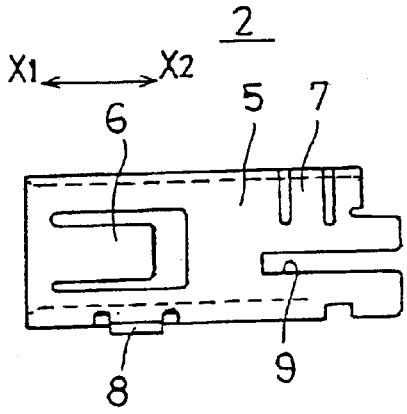
FIG. 4C PRIOR ART
Figure 5D:
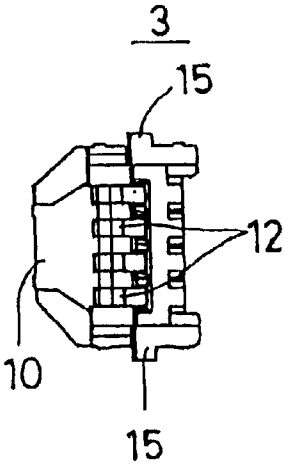
FIG. 5D PRIOR ART
FIGS. 5A through 5D are a plan view, a side view, a front view, and a rear view, respectively, of a housing of the conventional connector.
Figure 5A:
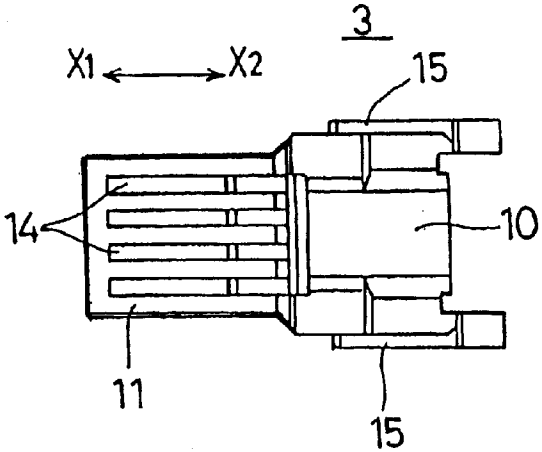
FIG. 5A PRIOR ART
Figure 5B:
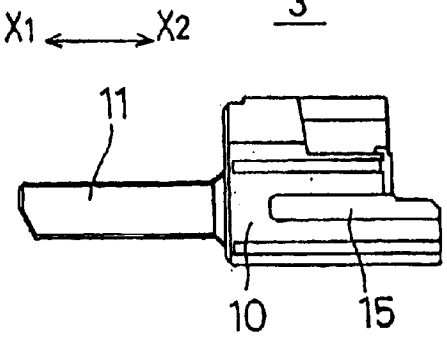
FIG. 5B PRIOR ART
Figure 5C:
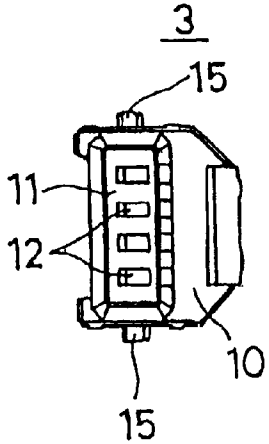
FIG. 5C PRIOR ART
Figure 6A:
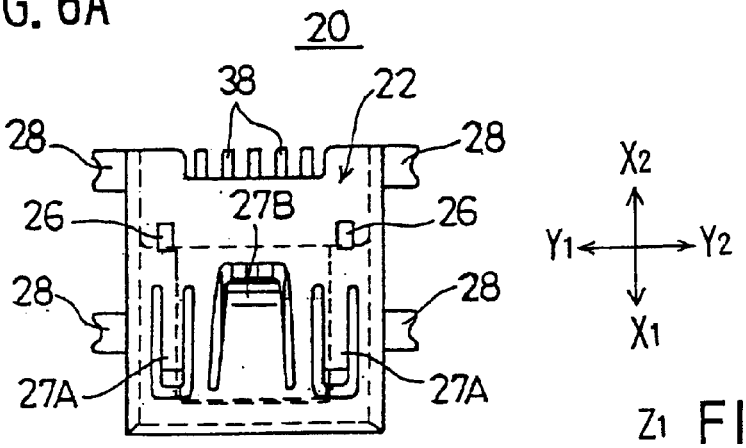
FIGS. 6A through 6C are a plan view, a front view, and a side view, respectively, of a connector according to an embodiment of the present invention.
Figure 6B:
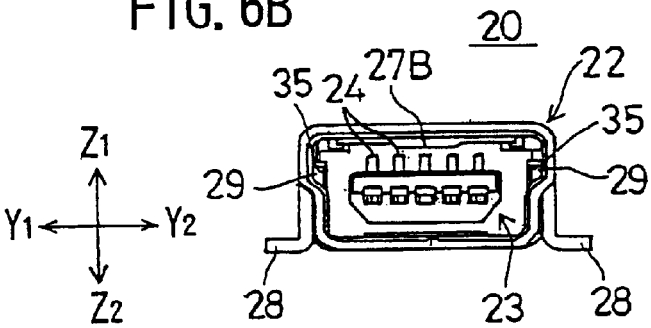
Figure 6C:
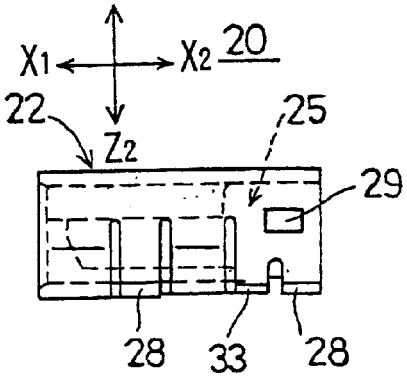
Figure 7:
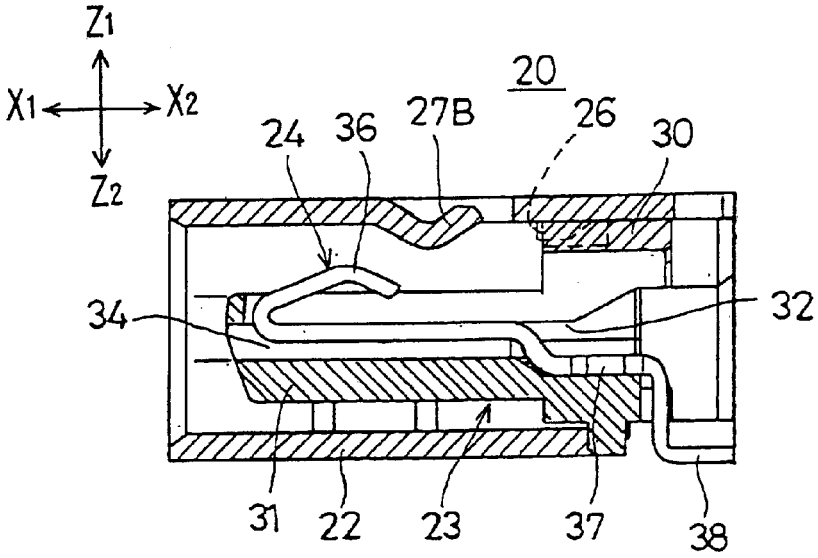
FIG. 7 is a sectional view of the connector of this embodiment.
Figure 8:
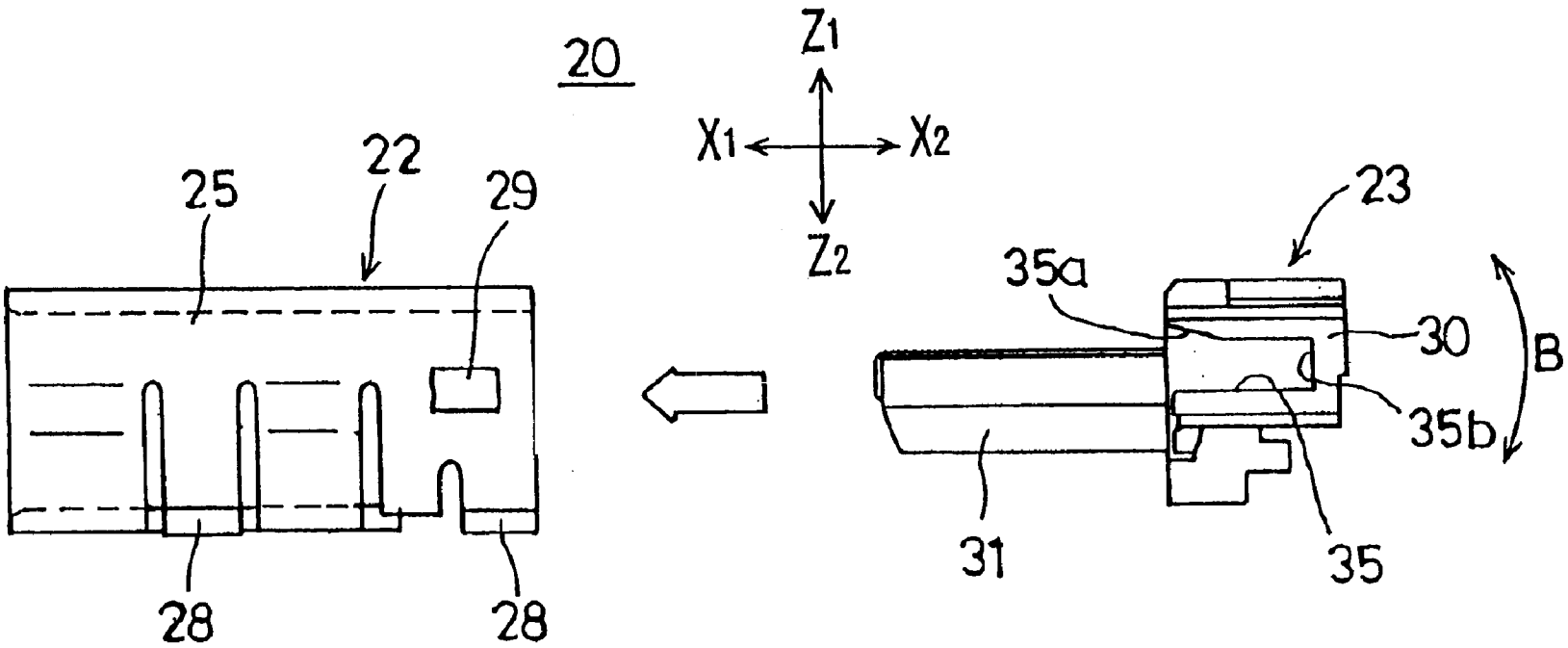
FIG. 8 is an exploded view of the connector of this embodiment.

FIGS. 6A through 8 are diagrams showing a connector 20 according to the embodiment of the present invention. FIGS. 6A through 6C are a plan view, a front view, and a side view of the connector 20, respectively. FIG. 7 is a sectional view of the connector 20. FIG. 8 is an exploded view of the connector 20. In this embodiment, a plug provided to a USB cable is attached to the connector 20.

In FIGS. 6A through 10D, the $X_1$–$X_2$ axis represents the length (or front-rear) dimension, the $Y_1$–$Y_2$ axis represents the width dimension, and the $Z_1$–$Z_2$ axis represents the height or vertical dimension of the connector 20.

The connector 20 is composed mainly of a shield case 22, a housing 23, and contacts 24. The contacts 24 are attached to the housing 23, which is attached inside the shield case 22.

The shield case 22 has a substantially cylindrical shape and is formed of conductive metal such as a copper alloy. As shown enlarged in FIGS. 9A and 9B, an upper fixed strip 27A is formed on each side of the upper surface of a cylindrical case main body 25, and an upper fixed strip 27B is formed on the upper surface of the case main body 25 in a middle position between the upper fixed strips 27A.

Each of the upper fixed strips 27A and 27B is formed to extend inward at an angle. Further, each of the upper fixed strips 27A and 27B has the function of holding the plug (of the USB cable) in an attached state by engaging the plug when the plug is attached to the connector 20.

Further, flange parts 28 and claw parts 33 are formed on a bottom part of the case main body 25. The flange parts 28 extend outward from the case main body 25. The flange parts 28 are connected to ground terminals formed on the circuit board of an electronic apparatus when the connector 20 is mounted on the circuit board. Thereby, the shield case 22 performs a shield function.

In this embodiment, the four flange parts 28 are formed in total, two on each of the $Y_1$ and $Y_2$ sides of the case main body 25. Further, in this embodiment, the flange parts 28 are formed to extend outward from the case main body 25 so that the connector 20 may be surface-mounted on the circuit board. However, the flange parts 28 may be formed to extend downward so that the connector 20 may function as a DIP type connector.

The claw parts 33 are bent inward inside the case main body 25. After the housing 23 is attached inside the shield case 22, the claw parts 33 are caulked so as to engage the housing 23. Thereby, the housing 23 is fixed inside the shield case 22.

Figure 9A:
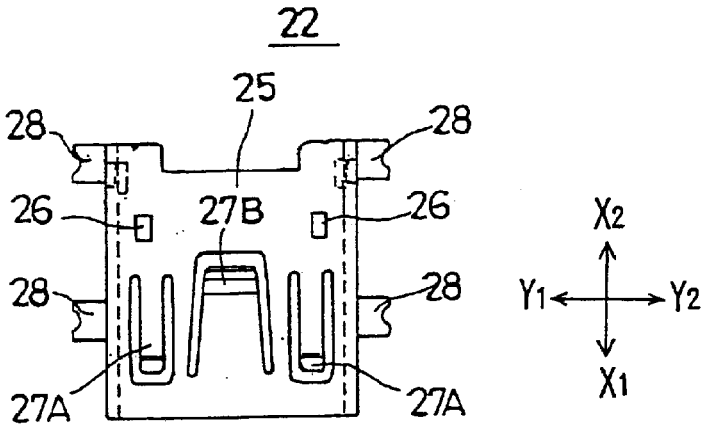
FIGS. 9A through 9D are a plan view, a front view, a side view, and a sectional view, respectively, of the connector of this embodiment.
Figure 9B:
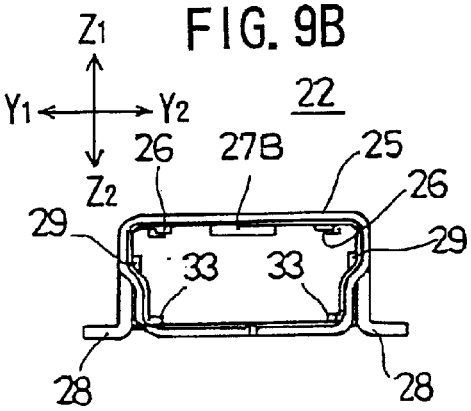
Figure 9C:
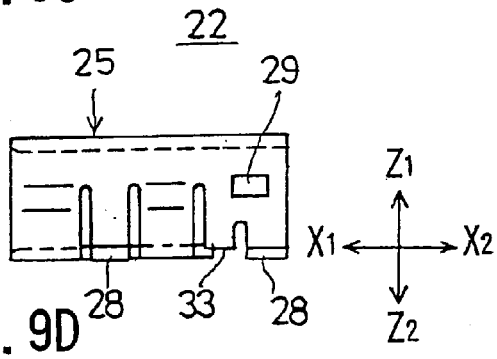
Figure 9D:
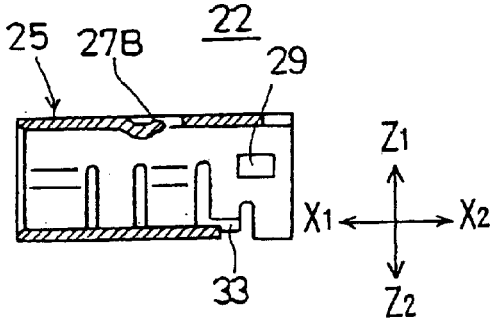

Further, an engaging convex part 29 is formed on each of the longitudinal sides ($Y_1$ and $Y_2$ side surfaces) of the case main body 25 forming the shield case 22. All of the engaging convex parts 29 are formed together when the case main body 25 is press-formed. As shown in FIG. 9B, the engaging convex parts 29 protrude inward inside the case main body 25.

On the other hand, the housing 23 is formed of resin. As shown enlarged in FIGS. 10A and 10B, the housing 23 includes a housing main body 30 and an extension part 31 that are formed integrally with each other. The contacts 24 are provided inside the housing 23 as shown in FIG. 7.

Each of the contacts 24 includes a connection part 36, a fixed part 37, and a terminal part 38 that are formed integrally with one another. The connection part 36 is formed by bending so as to extend upward with a spring characteristic. The connection part 36 is press-contacted to an electrode of the plug by spring force so as to be electrically connected thereto.

The fixed part 37 is press-fitted into a corresponding one of contact holes 32 formed in the housing main body 30 so that each contact 24 is fixed inside the housing 23. The terminal part 38 extends from the bottom surface of the housing 23 so as to be exposed to the outside thereof. The terminal part 38 is connected by soldering to an interconnection line formed on the circuit board on which the connector 20 is mounted.

Figures 10A, 10B, 10C, 10D:
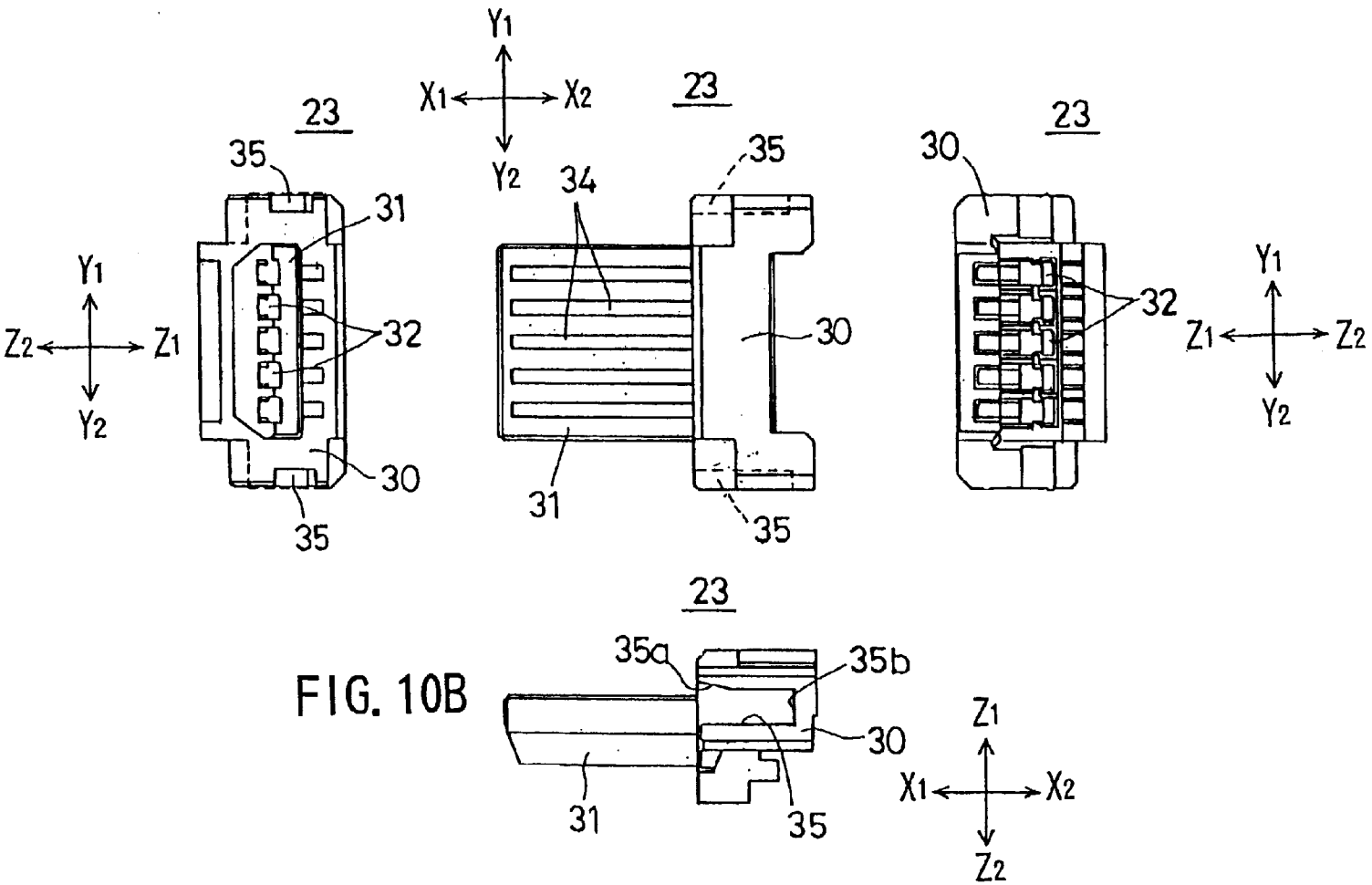
FIGS. 10A through 10D are a plan view, a side view, a front view, and a rear view, respectively, of the connector of this embodiment.

On the other hand, the extension part 31, which is formed integrally with the housing main body 30, extends in the $X_1$ direction from the housing main body 30 as shown in FIGS. 10A and 10B. Contact attachment grooves 34 are formed in the extension part 31 for the purpose of positioning the contacts 24 in given positions.

Further, an engaging groove 35 is formed on each of the $Y_1$ and $Y_2$ side parts of the housing main body 30. Each of the engaging grooves 35 has a concave shape in the corresponding side part of the housing main body 30 and extends along the $X_1$–$X_2$ axis for a given length as shown in FIGS. 8, 10A, and 10B. In addition, as shown in FIGS. 8 and 10B, a slope part 35*a* is formed in the $X_1$ end part of each of the engaging grooves 35.

Next, a description will be given, with reference to FIG. 8, of a method of assembling the connector 20. As shown in FIG. 8, in order to assemble the connector 20, the housing 23 in which the contacts 24 are provided beforehand is inserted into the shield case 22.

At this point, positions in which the engaging convex parts 29 are formed on the shield case 22 correspond to positions in which the engaging grooves 35 are formed in the housing 23. Therefore, in assembling the connector 20, first, positioning of the shield case 22 and the housing 23 are performed so that the engaging convex parts 29 coincide with the engaging grooves 35 of the housing main body 30, and then the housing 23 is inserted into the shield case 22. By this insertion, the engaging convex parts 29 move inside the engaging grooves 35 relatively in the $X_2$ direction of FIG. 8.

As previously described, the slope part 35*a* is formed in each of the engaging grooves 35. Thereby, positioning of the engaging convex parts 29 and the engaging grooves 35 can be performed with ease. Further, when the engaging convex parts 29 contact $X_2$ end parts 35*b* of the engaging grooves 35, the housing 23 is positioned, or placed in a given position, inside the shield case 22. Then, the claw parts 33 formed on the shield case 22 are caulked to engage the housing 23 so that the housing 23 is fixed inside the shield case 22.

As described above, in this embodiment, the engaging grooves 35 are formed in the resin housing 23, while the engaging convex parts 29 are formed on the shield case 22 formed of metal, which provides a higher mechanical strength than resin. Therefore, when the housing 23 is inserted into or extracted from the shield case 22 at the time of assembling or maintaining the connector 20, the engaging convex parts 29, which have such high mechanical strength, avoid being damaged.

Further, the engaging grooves 35, which are formed in the housing 23, have a higher mechanical strength than the engaging convex parts 15 formed on the resin housing 3 to protrude outwardly therefrom in the configuration of the conventional connector 1. Therefore, according to the configuration of this embodiment, even if the housing 23 is deformed in a direction indicated by arrow B in FIG. 8 at the time of or after being inserted into the shield case 22, the engaging convex parts 29 and the engaging grooves 35 are prevented from being chipped or deformed, thus increasing the reliability of the connector 20.

In this embodiment, the present invention is applied to the connector 20, to which the plug of a USB cable is attached. However, the present invention is not limited in application to such type of connector, but may also be applied to any connector in which contacts are attached to a housing.

As described above, according to the present invention, by forming the engaging grooves 35 in the housing 23 formed of resin and the engaging convex parts 29 on the shield case 22 formed of metal, the engaging grooves 35 and the engaging convex parts 29 are prevented from being damaged, thereby increasing the reliability of the connector 20.

The present invention is not limited to the specifically disclosed embodiment, but variations and modifications may be made without departing from the scope of the present invention.

The present application is based on Japanese priority application No. 2001-097101 filed on Mar. 29, 2001, the entire contents of which are hereby incorporated by reference.

What is claimed is:

1. A connector, comprising:

a shield case formed of metal;

a housing formed of resin, the housing comprising an extension part having contacts provided thereto and a main body part larger in size than the extension part the housing being Inserted into said shield case so as to be attached thereto;

engaging grooves formed in the main body part of said housing so as to extend up to an end of the main body in an insertion direction in which said housing is inserted into said shield case; and engaging convex parts formed on said shield case, wherein said engaging convex parts are press-fitted into said engaging grooves to engage said engaging grooves in surface contact therewith along the insertion direction when said housing is inserted into said shield case.

2. The connector as claimed in claim 1, wherein said shield case is formed of a copper alloy.

3. The connector as claimed in claim 1, wherein said engaging convex parts are formed to protrude inwardly inside said shield case.

4. The connector as claimed in claim 1, wherein: said engaging convex parts engage said engaging grooves with surfaces of said engaging convex parts extending along the insertion direction being in surface contact with surfaces of said engaging grooves extending along the insertion direction; and a slope part is formed in an end part of each of said engaging grooves in the insertion direction.

5. The connector as claimed in claim 4, wherein the slope part is provided to only one of opposing sides of each of said engaging grooves, the opposing sides extending along the insertion direction.

6. The connector as claimed in claim 1, wherein:

the main body part includes first and second opposing sides as in which said engaging grooves are formed, respectively; and the extension part extends from said main body part in the insertion direction, wherein a slope part is formed in an end part of each of said engaging grooves in the insertion direction.

7. The connector as claimed in claim 6, wherein said main body part and said extension part of said housing are formed integrally with each other.

8. The connector as claimed in claim 6, wherein:

the contacts are provided to a surface of the extension part of said housing; and the first and second opposing sides of the main body part are vertical to the surface of the extension part and extend parallel to the contacts.

9. The connector as claimed in claim 6, wherein said shield case comprises a main body part having opposing longitudinal sides on which said engaging convex parts are formed so as to engage said engaging grooves formed in the first and second sides of said main body part of said housing.

10. The connector as claimed in claim 9, wherein all of said engaging convex parts are formed together when said main body part of said shield case is press-formed.

11. The connector as claimed in claim 9, wherein said shield case further comprises flange parts to be connected to terminals formed on a circuit board of an electronic apparatus on which circuit board the connector is mounted, the flange parts provided to a bottom part of said main body part of said shield case.

12. The connector as claimed in claim 11, wherein said flange parts extend outward from the bottom part of said main body part of said shield case.

13. The connector as claimed in claim 11, wherein said flange parts extend toward the circuit board from the bottom part of said main body part of said shield case.

14. A connector, comprising:

a shield case formed of metal;

a housing formed of resin, the housing comprising an extension part having contacts provided thereto and a main body part larger in size than the extension part, the housing being inserted into said shield case so as to be attached thereto;

engaging grooves formed in the main body part of said housing so as to extend up to an end of the main body in a direction in which said housing is inserted into said shield case; and engaging convex parts formed on said shield case, wherein:

said engaging convex parts engage said engaging grooves when said housing is inserted into said shield case;

said main body part includes first and second opposing sides in which said engaging grooves are formed, respectively;

the extension part extends from said main body part in the direction in which said housing is inserted into said shield case;

a slope part is formed on an end part of each of said engaging grooves in the direction in which said housing is inserted into said shield case;

said shield case comprises a main body part having opposing longitudinal sides on which said engaging convex parts are formed so as to engage said engaging grooves formed in the first and second sides of said main body part of said housing; and said main body part of said shield case further comprises claw parts provided to a bottom part of said main body part, the claw parts being caulked to engage said housing after said housing is inserted into said shield case.

15. A connector, comprising:

a first member comprising a first part having contacts provided thereto and a second part larger in size than the first part;

a electrically conductive second member shielding said first member inserted into said second member so as to be attached thereto;

engaging grooves formed in the second part of said first member so as to extend up to an end of the second part in an insertion direction in which said first member is inserted into said second member; and engaging convex parts formed on said second member, wherein said engaging grooves and said engaging convex parts engage each other with said engaging convex parts being press-fitted into said engaging grooves to be in surface contact therewith along the insertion direction.

16. The connector as claimed in claim 15, wherein said first member is a housing formed of resin and said second member is a shield case formed of metal.

17. The connector as claimed in claim 15, wherein said second member is formed of a conductive material that provides a higher mechanical strength than a material of said first member.

18. The connector as claimed in claim 17, wherein the conductive material of said second member is metal and the material of said first member is resin.

19. A connector, comprising:

a shield case formed of metal;

a housing formed of resin, the housing comprising an extension part having contacts provided thereto and a main body part larger in size than the extension part, the housing being inserted into said shield case so as to be attached thereto;

engaging grooves formed in the main body part of said housing so as to extend up to an end of the main body in a direction in which said housing is inserted into said shield case; and engaging convex parts formed on said shield case, wherein said engaging convex parts engage said engaging grooves when said housing is inserted into said shield case;

the main body part includes first and second opposing sides in which said engaging grooves are formed, respectively;

the extension part extends from said main body part in the insertion direction;

the contacts are provided to a surface of the extension part of said housing; and the first and second opposing sides of the main body part are vertical to the surface of the extension part and extend parallel to the contacts.

* * * * *